US010079423B2

(12) United States Patent
Asrokin et al.

(10) Patent No.: US 10,079,423 B2
(45) Date of Patent: Sep. 18, 2018

(54) APPARATUS FOR ADJUSTING THE TILT ANGLE OF AN ANTENNA

(71) Applicant: Telekom Malaysia Berhad, Kuala Lumpur (MY)

(72) Inventors: Azhari Bin Asrokin, Seremban (MY); Rizal Helmy Bin Basri, Bangi (MY); Anas Bin Abas, Bangi (MY); Norman Bin Jamlus, Kuala Lumpur (MY)

(73) Assignee: TELEKOM MALAYSIA BERHAD, Kuala Lumpur (MY)

( * ) Notice: Subject to any disclaimer, the term of this patent is extended or adjusted under 35 U.S.C. 154(b) by 0 days.

(21) Appl. No.: 14/052,012

(22) Filed: Oct. 11, 2013

(65) Prior Publication Data

US 2014/0103184 A1 Apr. 17, 2014

(30) Foreign Application Priority Data

Oct. 15, 2012 (MY) ..... PI 2012004606

(51) Int. Cl.
*H01Q 1/12* (2006.01)
*H01Q 3/06* (2006.01)

(52) U.S. Cl.
CPC ..... *H01Q 1/125* (2013.01); *H01Q 1/1228* (2013.01); *H01Q 1/1264* (2013.01); *H01Q 3/06* (2013.01)

(58) Field of Classification Search
CPC .... H01Q 1/1228; H01Q 1/125; H01Q 1/1264; H01Q 1/246; H01Q 3/06; H01Q 3/08; F16M 2200/041; F16M 2200/042; F16M 2200/044; F16M 2200/045
USPC ..... 343/757, 763, 765, 766, 878, 880, 882, 343/890, 891, 892; 248/218.4, 219.1, 248/219.3, 219.4, 280.11, 281.11, 292.11, 248/325, 162.1, 123.11, 123.2, 274.1, 248/276.1, 277.1, 279.1, 284.1, 286.1, 248/287.1, 919, 922, 923
See application file for complete search history.

(56) References Cited

U.S. PATENT DOCUMENTS

| | | | | |
|---|---|---|---|---|
| 2,758,816 | A * | 8/1956 | Pickard et al. | 254/126 |
| 3,586,271 | A * | 6/1971 | Sloyan | 248/652 |
| 3,767,181 | A * | 10/1973 | Van der Burgt et al. | 267/136 |
| 3,995,797 | A * | 12/1976 | Knight | 248/184.1 |
| 4,082,244 | A * | 4/1978 | Groff | 248/280.11 |
| 4,580,436 | A * | 4/1986 | Nelson | 72/446 |
| 4,723,128 | A * | 2/1988 | Gasque, Jr. | H01Q 1/125 343/878 |
| 4,799,064 | A * | 1/1989 | Nakamura | H01Q 1/125 343/761 |
| 4,821,596 | A * | 4/1989 | Eklund | 74/479.01 |
| 4,912,994 | A * | 4/1990 | Roberts | 74/96 |
| 5,029,799 | A | 7/1991 | Bernier | |
| 6,037,913 | A * | 3/2000 | Johnson | 343/882 |
| 6,402,109 | B1 * | 6/2002 | Dittmer | 248/284.1 |

(Continued)

*Primary Examiner* — Jonathan Liu
*Assistant Examiner* — Guang H Guan
(74) *Attorney, Agent, or Firm* — McCarter & English, LLP

(57) ABSTRACT

An apparatus for adjusting a tilt angle of a vertically positioned antenna on a pole that includes a top mounting assembly formed by a first link and a second link, the first and second link each including a top edge and a bottom edge, the top edges of the first link and the second link are pivotally connected together by a first hinge such that the second link is rotatable about the first hinge in relation to the first link to adjust an angle between the first link and the second link.

7 Claims, 7 Drawing Sheets

(56) References Cited

U.S. PATENT DOCUMENTS

| | | | | |
|---|---|---|---|---|
| 6,604,722 | B1 * | 8/2003 | Tan | 248/276.1 |
| 6,886,701 | B2 * | 5/2005 | Hong et al. | 211/99 |
| 7,145,515 | B1 * | 12/2006 | Kim | 343/766 |
| 7,185,866 | B2 * | 3/2007 | Lee et al. | 248/328 |
| 7,240,400 | B2 * | 7/2007 | Bonham | E05D 5/06 16/238 |
| 7,252,277 | B2 * | 8/2007 | Sweere et al. | 248/371 |
| 7,345,870 | B2 * | 3/2008 | Shin | 361/679.27 |
| 7,537,189 | B2 * | 5/2009 | Jung et al. | 248/298.1 |
| 7,663,868 | B1 * | 2/2010 | Lam | 361/679.06 |
| 7,760,153 | B2 * | 7/2010 | Bulow | 343/765 |
| 8,350,778 | B2 * | 1/2013 | Yeh | H01Q 3/06 343/878 |
| 8,378,919 | B2 * | 2/2013 | Yeh | 343/882 |
| 8,505,952 | B1 * | 8/2013 | Choquette | B60D 1/54 280/491.2 |
| 8,655,409 | B2 * | 2/2014 | Linehan et al. | 455/562.1 |
| 9,478,845 | B2 * | 10/2016 | Hemmervall | |
| 2009/0021447 | A1 * | 1/2009 | Austin et al. | 343/880 |
| 2011/0168855 | A1 | 7/2011 | Bonczyk et al. | |
| 2012/0001044 | A1 * | 1/2012 | Gwag | 248/277.1 |
| 2012/0218159 | A1 * | 8/2012 | Ke et al. | 343/760 |
| 2013/0140424 | A1 * | 6/2013 | Frick et al. | 248/550 |
| 2014/0103184 | A1 * | 4/2014 | Asrokin et al. | 248/514 |
| 2016/0211576 | A1 * | 7/2016 | Vassilakis | H01Q 1/125 |

* cited by examiner

APPARATUS FOR ADJUSTING THE TILT ANGLE OF AN ANTENNA

FIELD OF INVENTION

The present invention relates to an apparatus for adjusting the tilt angle of a vertically positioned antenna on a pole.

BACKGROUND OF THE INVENTION

Antennas mounted high up on poles are protected from interference from other neighboring electronic devices and also reduces the exposure to electromagnetic fields for human and animals. It is however important that these antennas are configured in an accurate inclination in relative to an axis to direct and concentrate irradiation to a desired area.

An example of antenna mounting assembly allow tilt adjustment of the antenna is U.S. Patent Application No. 2011/0168855 that depicts a rotating mounting assembly comprising an extension member and a downtilt member being coupled together by a plurality of revolving nutplate hinges such that the downtilt member rotates about the nutplate hinges in relative to the extension member. Each nutplate hinge is formed by an extension flange hinge tab and a downtilt flange hinge tab engaging one another. The coaxial alignment of apertures on the extension hinge tab with apertures on a downtilt hinge tab that is resulted from rotating the downtilt member forms a plurality of adjustment features which accepts a fastener for securing the revolving nutplate hinge in a fixed position.

A downtilt support bracket for mounting an antenna on a metallic tower is disclosed in U.S. Pat. No. 5,029,799. This apparatus enables spatial positioning of the antenna by a pipe section. The antenna comprises a pole member with a free end pivotally mounted on a transversal pivot that bridges a pair of spaced apart parallel plates of the bracket. A bolt and nut assembly traverses the pole member and two arcuate slots are respectively formed in the parallel plates, wherein the pole member is rotated about the pivot with the bolt sliding in the two arcuate slots. When a desired position for the pole member is reached, the bolt and nut assembly is tightened to secure the pole member and the antenna in position.

Whilst both prior arts enable the tilt of the antenna to be adjusted and locked at a desired position, the convenience and safety to perform the adjustment were overlooked. The rotating mounting assembly disclosed in U.S. 2011/0168855 requires manual adjustment of the tilt and fastening of the fasteners. The apparatus in U.S. Pat. No. 5,029,799 provides an easier way to adjust the tilt of the antenna by rotating the pole member along the arcuate slot as compared to U.S. 2011/0168855. However, the apparatus similarly requires manual rotating of the pole member and manual fastening of the bolt and nut assembly. Not only is the adjusting work not convenient to be conducted as the person handling the work has to reach a position where he could reach the assembly which is usually mounted at a high position on a pole to rotate the downtilt member or pole handle and securing the tilt in position by fasteners, it also poses danger to the person carrying out the work due to the height of the antenna, the exposure to electromagnetic radiation as well as the high risk of electric shock.

Solutions are thus needed to address the drawbacks of the prior arts mentioned above. Easy and safe adjustment of the tilt, as well as effective locking of the assembly upon being adjusted to a desired tilt angle are the key features of an ideal antenna mounting assembly.

SUMMARY OF INVENTION

The main aspect of the present invention is to provide an apparatus for adjusting the tilt angle of an antenna that is mounted on a pole.

Another aspect of the present invention is to provide an apparatus for securing the position of an antenna on a pole upon adjusting its tilt angle.

Still another aspect of the present invention is to provide an apparatus that enables manual and automate adjusting of the tilt angle of an antenna.

Yet another aspect of the present invention is to provide an apparatus having a mechanism that makes adjusting of the tilt angle of an antenna easy.

Also another aspect of the present invention is to provide an apparatus that ensures safety of the person adjusting the tilt angle of an antenna on a pole.

At least one of the preceding aspects is met, in whole or in part, by the present invention, in which the embodiment of the present invention describes an apparatus for adjusting a tilt angle (304) of a vertically positioned antenna (301) on a pole (300) comprising a top mounting assembly (100) formed by a first link (101) and a second link (102) that has a top edge and a bottom edge each, the top edges of both links (101, 102) are pivotally connected together by a first hinge (103) such that the second link (102) is rotatable about the first hinge (103) in relative to the first link (101) to adjust an angle (305) between the links (101, 102) while the bottom edge of the first link (101) has a clamp (105) that is pivotally connected to its outer surface by a second hinge (104) for affixing the top mounting assembly (100) to the upper portion of the pole (300) and the bottom edge of the second link (102) has an antenna bracket (106) at its outer surface for affixing the top mounting assembly (100) to the upper portion of the antenna (301), wherein the second link (102) is fabricated with a slot (112) at one of its lateral side; a shaft having a threaded portion (108) that has a first end joined to a socket assembly (109) and a second end, the shaft being connected to the top mounting assembly (100) by engaging a fastener (111) at the end of the socket assembly (109) onto the slot (112); a bottom mounting assembly (200) for affixing the lower portion of the antenna (301) to the lower part of the pole (300); wherein the fastener (111) is slidable along the slot (112) upon receiving a push or pull force from the shaft through rotating the threaded portion (108) in a forward or backward movement to allow the second link (102) to rotate about the first hinge (103) in which the rotation of the second link (102) exerts a force to the top edge of the first link (101) that results in the first link (101) to rotate about the second hinge (104) for adjusting the angle (305) between the two links (101, 102) which leads to the adjustment of the tilt angle (304) of the antenna (301).

DETAILED DESCRIPTION OF THE INVENTION

Figure 1:
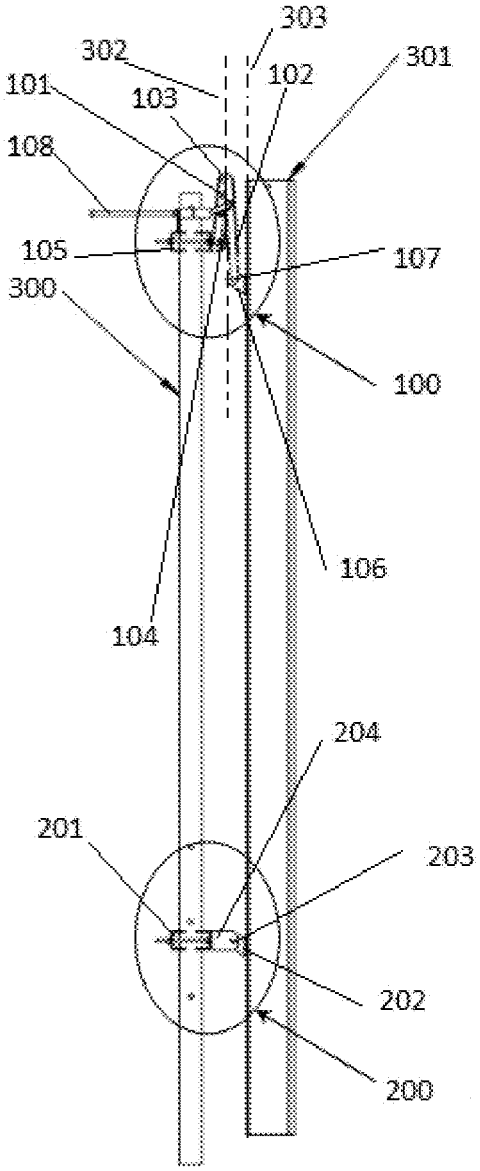
FIG. 1 is a diagram showing the top mounting assembly and the bottom mounting assembly holding the antenna vertically on a pole without any inclination of the antenna.

The present invention discloses an apparatus for adjusting a tilt angle (304) of a vertically positioned antenna (301) on a pole (300) comprising a top mounting assembly (100) formed by a first link (101) and a second link (102) that has a top edge and a bottom edge each, the top edges of both links (101, 102) are pivotally connected together by a first hinge (103) such that the second link (102) is rotatable about the first hinge (103) in relative to the first link (101) to adjust an angle (305) between the links (101, 102) while the bottom edge of the first link (101) has a clamp (105) that is pivotally connected to its outer surface by a second hinge (104) for affixing the top mounting assembly (100) to the upper portion of the pole (300) and the bottom edge of the second link (102) has an antenna bracket (106) at its outer surface for affixing the top mounting assembly (100) to the upper portion of the antenna (301), wherein the second link (102) is fabricated with a slot (112) at one of its lateral side; a shaft having a threaded portion (108) that has a first end joined to a socket assembly (109) and a second end, the shaft being connected to the top mounting assembly (100) by engaging a fastener (111) at the end of the socket assembly (109) onto the slot (112); a bottom mounting assembly (200) for affixing the lower portion of the antenna (301) to the lower part of the pole (300); wherein the fastener (111) is slidable along the slot (112) upon receiving a push or pull force from the shaft through rotating the threaded portion (108) in a forward or backward movement to allow the second link (102) to rotate about the first hinge (103) in which the rotation of the second link (102) exerts a force to the top edge of the first link (101) that results in the first link (101) to rotate about the second hinge (104) for adjusting the angle (305) between the two links (101, 102) which leads to the adjustment of the tilt angle (304) of the antenna (301).

Figure 2:
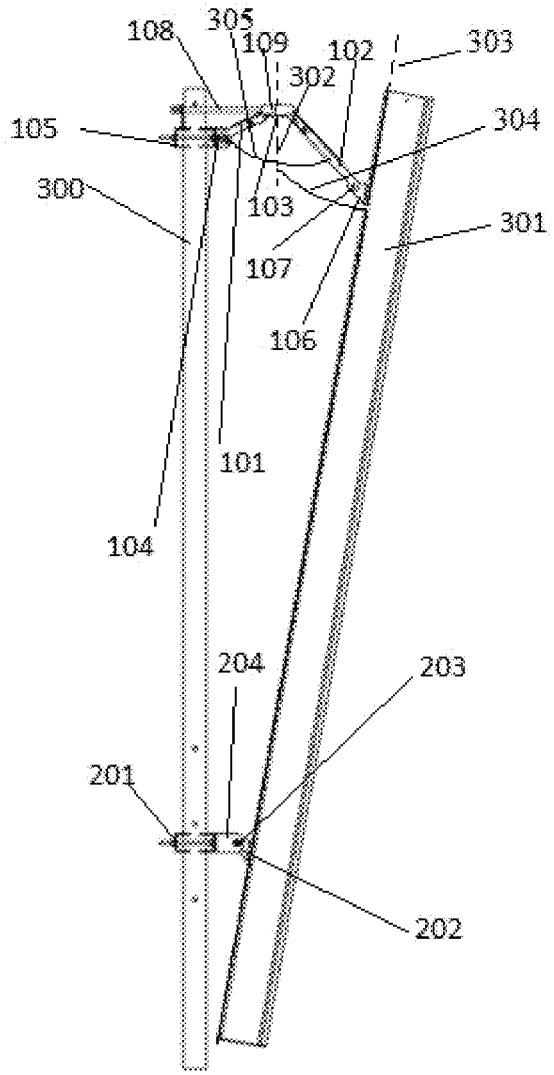
FIG. 2 is a diagram showing the top mounting assembly and the bottom mounting assembly holding the antenna vertically on a pole with the antenna being inclined downwards at a tilt angle in relative of the vertical axis of the pole.
Figure 3:
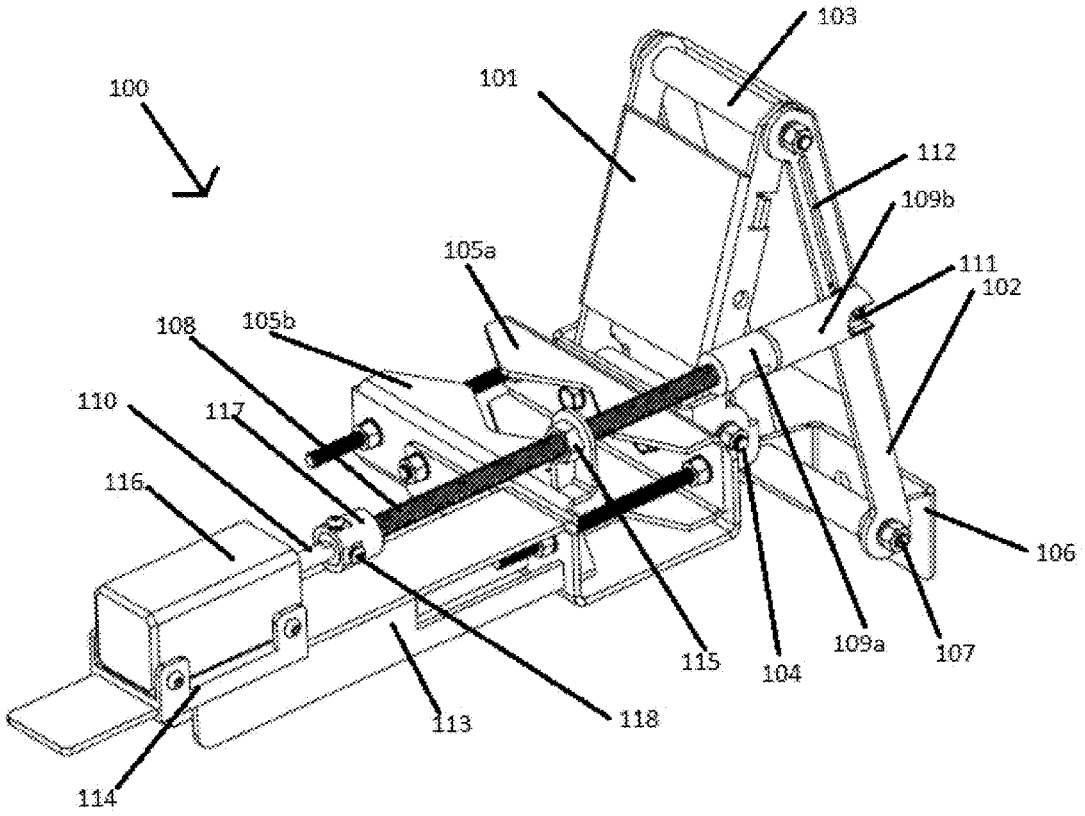
FIG. 3 shows a perspective view of the top mounting assembly.
Figure 4:
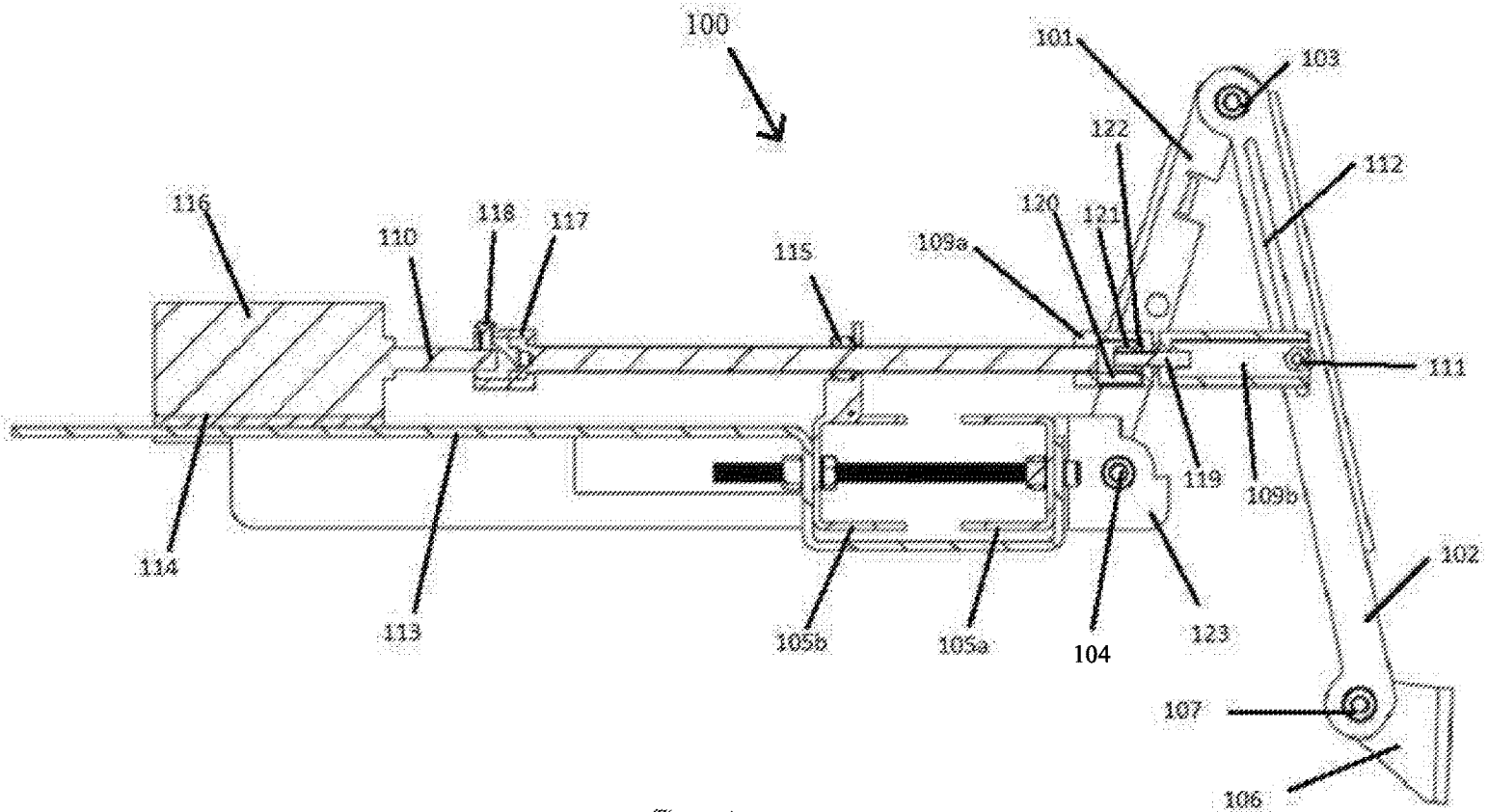
FIG. 4 shows a side view of the top mounting assembly.

As indicated in FIG. 1, the antenna (301) is retained in a vertical position on the pole (300) by the two mounting assemblies (100, 200). The bottom mounting assembly (200) holds the pole (301) in static while the top mounting assembly (100) allows the top portion of the antenna (301) to be tilted downwards for forming the tilt angle (304) as illustrated in FIG. 2 to direct and concentrate irradiation to a desired area. The tilt angle (304) of the preferred embodiment described herein is defined as the angle between the vertical axis (302) of the first hinge (101) and longitudinal axis (303) of the antenna (301). The antenna should be held in a straight vertical line as shown in FIG. 1 when there is no tilting of the antenna (301).

By utilizing the pivotally joined first (101) and second (102) link to connect the pole (300) and the antenna (301), the tilt angle (304) between the pole (300) and the antenna (301) could be varied. The first link (101) is mounted with the clamp (105) is used for securing the upper portion of the pole (300) tightly whereas the second link (102) is affixed with the antenna bracket (106) that used for mounting to the upper part of the antenna (301). Both links (101, 102) are configured in an inverted V-shaped arrangement with their top edges hinged together by a first hinge (103). The first hinge (103) allows the second link (102) to rotate about the first hinge (103) in relative to the first link (101). On the other hand, the bottom edge of the first link (101) is pivotally hinged to the clamp (105) by a second hinge (104) such that the first link (101) is rotatable about the second hinge (104). With reference to FIGS. 3 to 6, it could be seen that one of the lateral edges of the second hinge (102) is fabricated with a slot (112).

A push or full force exerted to the second link (102) is needed in order to adjust the angle (305) between the first (101) and second (102) link for tilting the antenna (301) downwards. The shaft functions as a pushing or pulling means to rotate the second link (102) in order to trigger the movement of the first link (101). In a preferred embodiment, the shaft has an elongate threaded portion (108) that has its first end connected to a socket assembly (109) and a second end joined to a handle (110). The threaded portion (108) is rotated to move the shaft forward or backwards. Preferably, the forward movement of the shaft is made possible by rotating the threaded portion (108) in a clockwise direction and conversely, the backward movement is done by rotating the threaded portion (108) in an anti-clockwise direction.

Figure 9:
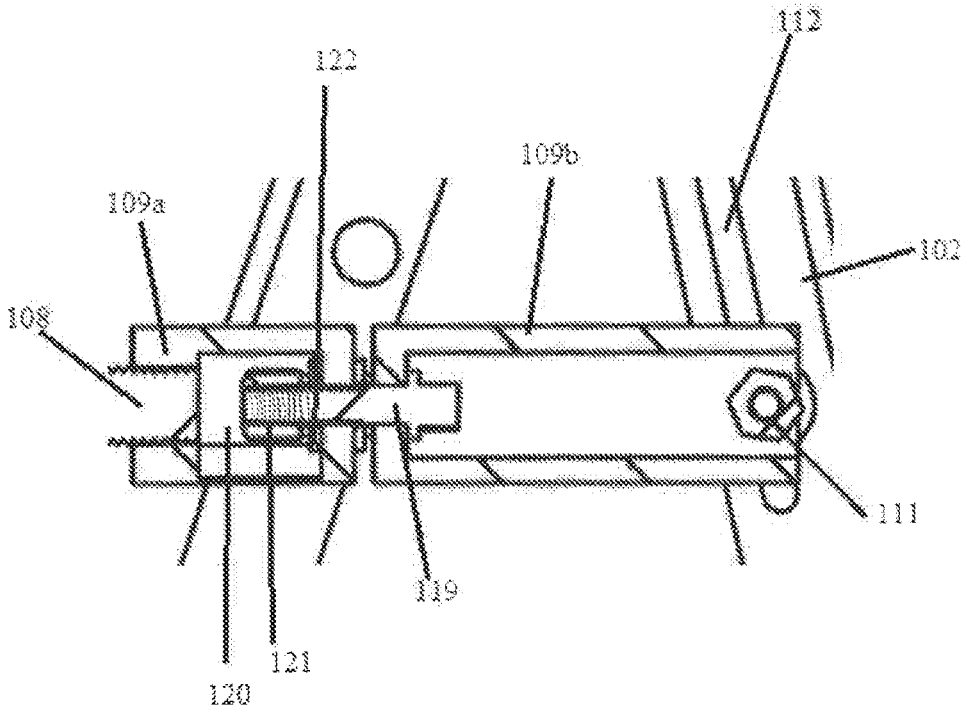
FIG. 9 shows the connection of the threaded portion of the shaft to the socket assembly.

FIG. 9 shows the connection between the threaded portion (108) and the socket assembly (109). The socket assembly (109) comprises a primary socket (109*a*) and a secondary socket (109*b*) that are joined together by a screw (119) having a threaded part and a non-threaded part. The primary socket (109*a*) has a first opening with a larger diameter at one end of the primary socket (109*a*) and a second opening with a smaller diameter at the other end of the primary socket (109*a*). A divider (120) is included within the primary socket (109*a*) to divide it into a first portion and a second portion. The first portion is defined as a passage extending from the first opening till the divider (120) for receiving the first end of the threaded portion (109) of the shaft and the second portion is defined as a passage extending from the divider till the second opening for receiving the threaded part (108) of the screw (119). The two openings of the primary socket (109*a*) are threaded for receiving threaded elements. A nut (121) is included inside the second portion to mate with the screw (119) with a washer (122) optionally added within the second portion to ensure tightness of the nut-screw joint. The secondary socket (109*b*) has an opening at one of its end for receiving the non-threaded portion of the screw (119). The fastener (111) that connects the shaft with the second link (102) is mounted at the lateral surface of the other end of the secondary socket (109*b*) for engaging onto the slot (112) of the second link (102).

With this arrangement, the shaft is positioned adjacently to the lateral side of the second link (102) where the slot (112) is fabricated. Such configuration of the joint of the threaded portion (108) and the socket assembly (109) causes the movement of the socket assembly (109) to correspond to the movement of the threaded portion (108). When the threaded portion (108) rotates and moves in a forward direction, the first socket (109*a*) rotates together with the threaded portion (108) and hence pushes the second socket (109*b*) that does not rotate forward. With the second socket (109*b*) moving forward, a push force is exerted to the second link (102) through the fastener (111) that is engaging onto the slot (112) of the second link (102). The slot (112) allows forces to be exerted onto the second link (102) and controls the rotation movement of the second link (102) about the first hinge (103) through the length of the slot (112) that allows the fastener (111) to slide.

Upon receiving the push force, the second link (102) tilts upwards due to the rotation of the second link (102) around the first hinge (103), increasing the angle (305) between the first link (101) and the second link (102). At the same time, the height of the first hinge (103) where the two top edges of the links (101, 102) meet lowers, exerting a force at the top edge of the first link (101) to push the first link (101) downwards by downwardly rotating the first link (101) around the second hinge (104). With the increase of the angle (305) between the links (101, 102), the antenna (301) mounted on the bottom edge of the second link (102) tilts downwards and away from the pole, forming an increasing tilt angle (204) in relative to the vertical axis of the first hinge (103).

Figure 5:
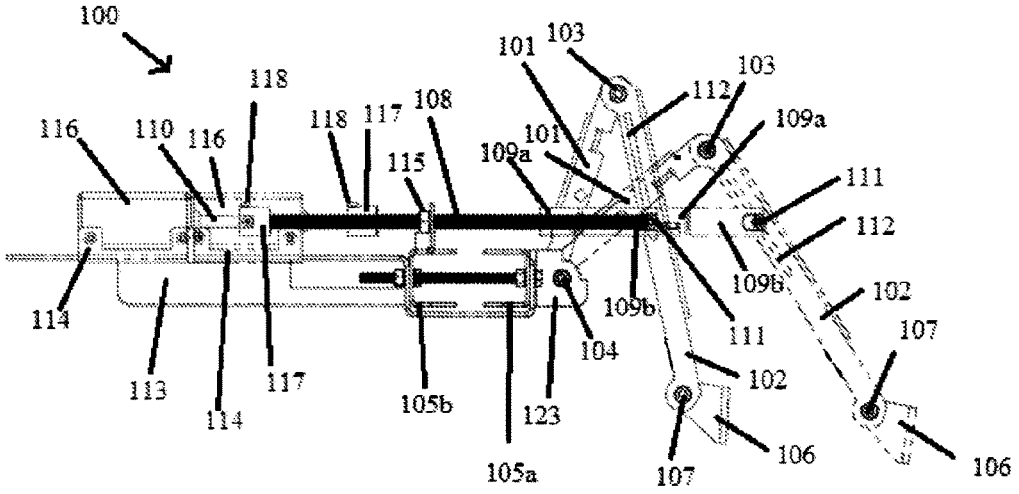
FIG. 5 is the perspective view of the top mounting assembly showing the rotation movement of the first and second hinge to adjust the angle between the first and second links.
Figure 6:
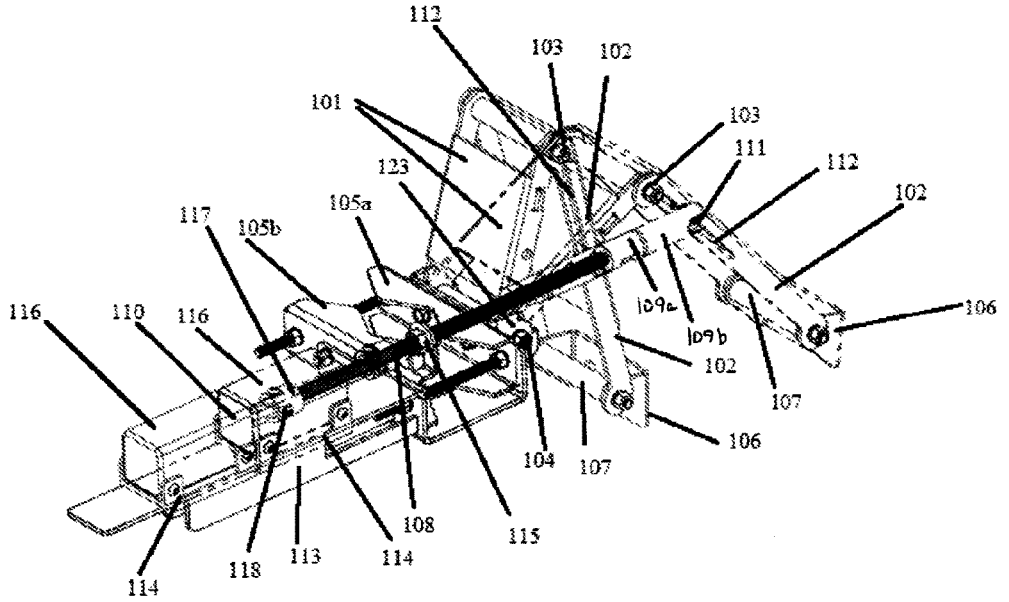
FIG. 6 is the side view of the top mounting assembly showing the rotation movement of the first and second hinge to adjust the angle between the first and second links.

On the other hand, when the threaded portion (108) rotates in a direction to move backwards, the first socket (109*a*) follows the rotation and backward movement of the threaded portion (108) and thus pulls the second socket (109*a*) backwards as well. The fastener (111) engaging into the slot (112) exerts a pull force to the second link (102), causing the second link (102) to tilt downwards which leads to the increase in height of the first hinge (103) and the decrease in the angle (305) between the first link (101) and second link (102). The heightening of the first hinge (103) raises the height of the top edge of the first link (101), causing the first link (101) to tilt upwards by upwardly rotating the first link (101) about the second hinge (104). With the decrease in the angle (305) between the links (101, 102), the antenna (301) mounted on the bottom edge of the second link (102) tilts upwards and towards the pole (300), forming a decreasing tilt angle (304) in relative to the vertical axis of the first hinge (103). The movement of the two links (101, 102) is illustrated in FIG. 5 and FIG. 6.

Figure 8:
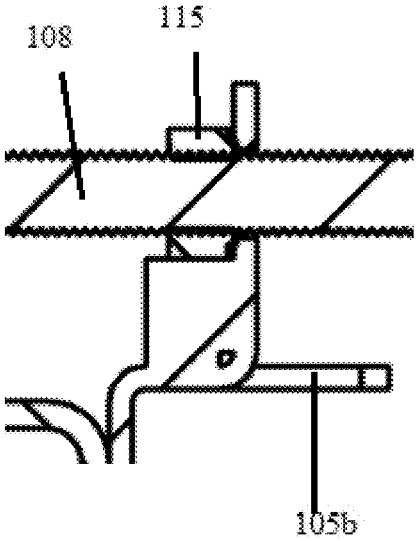
FIG. 8 shows the connection of the threaded portion of the shaft to the clamp.

The antenna bracket (106) employed for the antenna (301) to be mounted thereon is affixed to the bottom edge of the second link (102) by a forth hinge (107). The clamp (105) that is affixed to the bottom edge of the second link (102) by the second hinge (104), on the other hand, has a pair of clamping plates (105*a*, 105*b*) that each having a mounting surface and a clamping surface. The clamping surfaces are preferred to have two V-shaped teeth that are joined together by a groove each. The clamping surfaces are positioned to face each other for clamping the pole (300). The pole (300) is clamped in between the grooves of the two facing clamping surfaces. The mounting surface of the second clamping plate (105*b*) is mounted to the first link (101). In the preferred embodiment, the mounting surface that is mounted to the first link (101) is equipped with a U-bracket (123) whereby a second hinge (104) is made thereon to join the clamp (105) with the bottom edge of the first link (101). With reference to FIG. 8, a protrusion having a nut (115) is fabricated on top of the first clamping plate (105*a*). The nut (115) serves to hold and lock the threaded portion (108) of the shaft in position.

Figure 7:
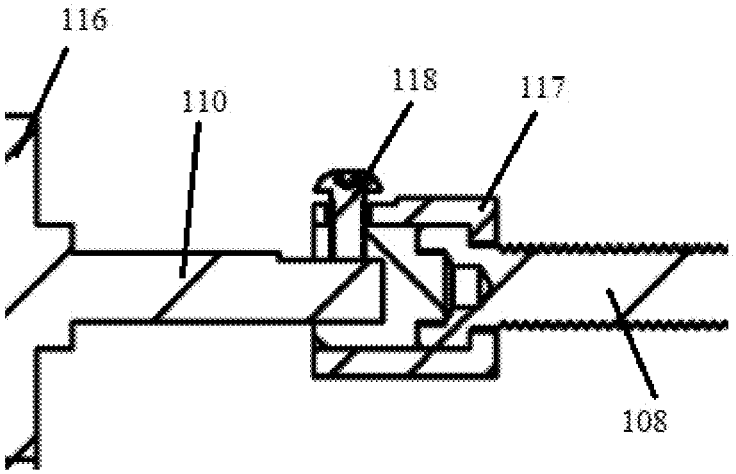
FIG. 7 shows the connection of the handle to the threaded portion of the shaft.

To ease the manual rotation of the threaded portion (108), a handle (110) could be connected to the second end of the threaded portion as shown in FIG. 7. A socket (117) is provided at the second end of the threaded portion (108) that joins the rod of the handle (110) with the threaded portion (108). A portion of the rod that is inserted into the socket (117) is secured in place by at least a screw (118). Besides that, the handle (110) could also serve as a joining means for the threaded portion (108) of the shaft and a remote control unit (116). The remote control unit (116) which includes a motor and gear makes automatic rotation of the shaft possible and hence it could be connected to the threaded portion (108) directly or through the handle (110) or other joining means that connects the threaded portion (108) and the remote control unit (116) together. By remotely controlling the rotation of the shaft, the antenna (301) could be tilted without the need of any human to reach the position of the top mounting assembly (100) to adjust the tilt angle (304) of the antenna (310) which is troublesome and dangerous.

A sliding platform (113) with a track could be included for the remote control unit (116) to slide while following the movement of the shaft. The sliding platform (113) includes a holder (114) that holds the remote control unit (116) while sliding along the track. The sliding platform (113) is affixed to the mounting surface of the first clamping plate (105*a*). The length of the sliding platform (113) determines the travel path and distance of the remote control unit (116) for restricting the tilting of the antenna (301) to a certain range of the tilt angle (305).

Figure 10:
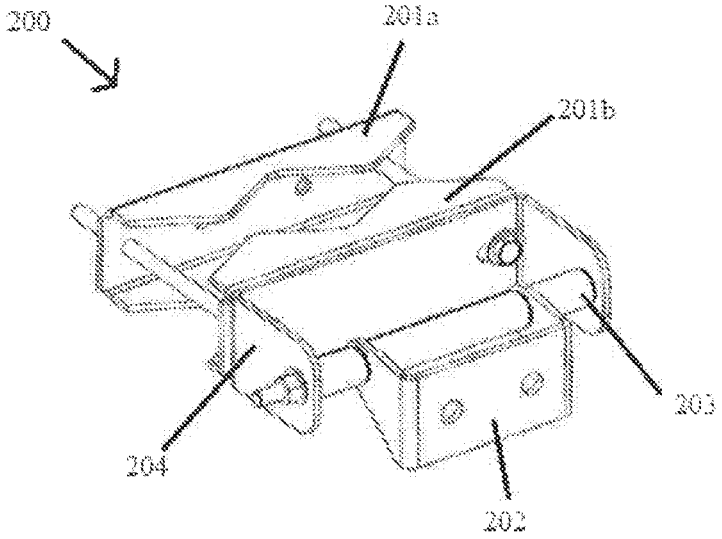
FIG. 10 is a perspective view of the bottom mounting assembly.

FIG. 10 shows a preferred embodiment of the bottom mounting assembly (200) which comprises a pole clamp (201) and a bracket (202) that are connected together by a U-bracket (204). A third hinge (204) is utilized to join the bracket (202) that mounts to the antenna (301) and the pole clamp (201). The bottom mounting assembly (200) should remain static during the tilting of the antenna (301) by the top mounting assembly (100). It is preferred that the clamp (201) is formed by two clamping plates (201*a*, 201*b*) that each has a mounting surface and a clamping surface. The clamping surfaces of both plates (201*a*, 201*b*) are positioned to face each other with two V-shaped teeth that are connected by a groove which clamps the pole (300) in between the two clamping surfaces of the clamping plates (201*a*, 201*b*). The U-bracket (204) is mounted to the mounting surface of one of the clamping plates (201) whereby the third hinge (203) is used to attach the U-bracket (204) with the bracket (202) that mounts to the lower portion of the antenna (301).

Although the description above contains many specifications, it is understood that the embodiments of the preferred form are not to be regarded as a departure from the invention and it may be modified within the scope of the appended claims.

The invention claimed is:

1. An apparatus for adjusting a tilt angle of a vertically positioned antenna on a pole, the apparatus comprising:

a top mounting assembly including a first link and a second link, the first link and the second link each including a top edge and a bottom edge, the top edges of the first link and the second link are pivotally connected together by a first hinge such that the second link is rotatable about the first hinge in relation to the first link to adjust an angle between the first link and the second link;

wherein the bottom edge of the first link is pivotably connected to a clamp via a second hinge for affixing the top mounting assembly to an upper portion of the pole, and the bottom edge of the second link is pivotably connected to an antenna bracket for affixing the top mounting assembly to an upper portion of the antenna, wherein the second link has a slot on a lateral side of the second link;

a shaft having a threaded portion, the threaded portion having a first end and a second end, the first end being joined to a primary socket, the primary socket having a first opening at a first end of the primary socket and a second opening at a second end of the primary socket, wherein the primary socket is divided into a first portion and a second portion by a divider, the first portion being defined as a passage extending from the first opening till the divider for receiving the first end of the threaded portion of the shaft, and the second portion being defined as a passage extending from the divider till the second opening;

a secondary socket having an opening at a proximal end of the secondary socket, the secondary socket in communication with the primary socket at the proximal end via a screw having a threaded part and a non-threaded part, wherein the screw connects the primary socket and the secondary socket together with the second opening of the primary socket receiving the threaded part of the screw and the opening of the secondary socket receiving the non-threaded part of the screw such that the primary socket is configured to rotate together with the shaft and exert a push or pull force to the secondary socket to move the secondary socket forward or backward, the secondary socket being connected to the top mounting assembly at a distal end by a fastener, the fastener engaging the secondary socket onto the slot, so that the secondary socket is adjacent to the lateral side of the second link;

a bottom mounting assembly for affixing a lower portion of the antenna to a lower portion of the pole;

wherein the fastener is slidable along the slot upon receiving the push or pull force from the shaft by rotating the threaded portion such that the threaded portion moves forward or backward with respect to the clamp to allow the second link to rotate about the first hinge, wherein the rotation of the second link is configured to exert a force to the top edge of the first link, to allow the first link to rotate about the second hinge for adjusting the angle between the first link and the second link, thereby allowing for adjustment of the tilt angle of the antenna.

2. An apparatus according to claim 1, wherein the shaft is connected to a handle at the second end of the threaded portion.

3. An apparatus according to claim 1, wherein the clamp has a nut for holding and securing the threaded portion of the shaft that passes through the nut.

4. An apparatus according to claim 1, wherein the clamp has a first clamping plate and a second clamping plate, each of the first clamping plate and the second clamping plate having a mounting surface and a clamping surface, the clamping surfaces being positioned to face each other for clamping the pole and the mounting surface of the second clamping plate is mounted to the first link.

5. An apparatus according to claim 4, further comprising a sliding platform affixed to the mounting surface of the first clamping plate to provide a track for a remote control unit to slide along during the forward or backward movement of the shaft.

6. An apparatus according to claim 1, further comprising a remote control unit connected to the shaft for remotely controlling the rotation of the shaft.

7. An apparatus according to claim 1, wherein the bottom mounting assembly comprises a pole clamp and a bracket pivotally connected to the pole clamp by a third hinge for mounting to the lower portion of the antenna to allow the lower portion of the antenna to be rotatable about the third hinge.

* * * * *